US010822141B1

(12) United States Patent
Qi et al.

(10) Patent No.: US 10,822,141 B1
(45) Date of Patent: Nov. 3, 2020

(54) PALLET

(71) Applicants: INVENTEC (PUDONG) TECHNOLOGY CORPORATION, Shanghai (CN); INVENTEC CORPORATION, Taipei (TW)

(72) Inventors: De bin Qi, Shanghai (CN); Xiaowei Zhang, Shanghai (CN); Xuefeng Chen, Shanghai (CN)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 16/596,413

(22) Filed: Oct. 8, 2019

(30) Foreign Application Priority Data

Sep. 5, 2019 (CN) ..... 2019 1 0841203

(51) Int. Cl.
*B65D 19/00* (2006.01)

(52) U.S. Cl.
CPC ..... *B65D 19/0012* (2013.01); *B65D 2519/00029* (2013.01); *B65D 2519/00064* (2013.01); *B65D 2519/00104* (2013.01); *B65D 2519/00134* (2013.01); *B65D 2519/00273* (2013.01); *B65D 2519/00288* (2013.01); *B65D 2519/00318* (2013.01); *B65D 2519/00378* (2013.01); *B65D 2519/00407* (2013.01)

(58) Field of Classification Search
CPC ..... B65D 19/0012; B65D 19/0053; B65D 19/0055; B65D 2519/0073
See application file for complete search history.

(56) References Cited

U.S. PATENT DOCUMENTS

| | | | | |
|---|---|---|---|---|
| 3,949,929 | A * | 4/1976 | Kupersmit | B65D 19/20 206/600 |
| 4,194,255 | A * | 3/1980 | Poppe | A47C 27/065 267/153 |
| 5,102,107 | A * | 4/1992 | Simon | F16F 1/377 267/152 |
| 6,418,862 | B1 * | 7/2002 | Heil | B65D 19/0028 108/57.12 |
| 8,720,350 | B2 * | 5/2014 | Bush | B65D 19/0073 108/57.12 |
| 9,227,757 | B1 * | 1/2016 | Green | B65D 19/0095 |
| 9,284,107 | B2 * | 3/2016 | Schultz | F16F 15/067 |
| 2007/0221102 | A1 * | 9/2007 | Reinhall | B65D 19/0073 108/57.12 |
| 2008/0000397 | A1 * | 1/2008 | Dickinson | B65D 19/20 108/55.3 |
| 2008/0087203 | A1 * | 4/2008 | Hartel | B65D 19/0026 108/57.31 |
| 2011/0192326 | A1 * | 8/2011 | Ingham | B65D 19/0048 108/57.17 |

(Continued)

*Primary Examiner* — Daniel J Rohrhoff
(74) *Attorney, Agent, or Firm* — Maschoff Brennan

(57) ABSTRACT

This disclosure relates to a pallet includes a first board, a second board, a first elastic component and a second elastic component. The first elastic component and the second elastic component are disposed between the first board and the second board, and the second elastic component is closer to an edge of the second board than the first elastic component. The second elastic component has a density higher than that of the first elastic component.

9 Claims, 8 Drawing Sheets

(56) References Cited

U.S. PATENT DOCUMENTS

| | | | | |
|---|---|---|---|---|
| 2013/0233760 | A1* | 9/2013 | Polando | B65D 65/44<br>206/591 |
| 2017/0107013 | A1* | 4/2017 | Yoshifusa | B65D 19/0069 |
| 2018/0282019 | A1* | 10/2018 | Harber | B65D 81/02 |
| 2019/0092521 | A1* | 3/2019 | Zimmerman | B65D 19/0002 |

* cited by examiner

PALLET

CROSS-REFERENCE TO RELATED APPLICATIONS

This non-provisional application claims priority under 35 U.S.C. § 119(a) on Patent Application No(s). 201910841203.6 filed in China, P.R.C. on Sep. 5, 2019, the entire contents of which are hereby incorporated by reference.

TECHNICAL FIELD

The present disclosure relates to a pallet, more particularly to a pallet having elastic components of different densities.

BACKGROUND

In the field of logistics, pallets are commonly used to support various types of goods while being lifted by a forklift or pallet jack in order to transport the goods in an efficient manner.

SUMMARY

According to one aspect of the present disclosure, a pallet includes a first board, a second board, a first elastic component and a second elastic component. The first elastic component and the second elastic component are disposed between the first board and the second board. The second elastic component is closer to an edge of the second board than the first elastic component. The second elastic component has a density higher than that of the first elastic component.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
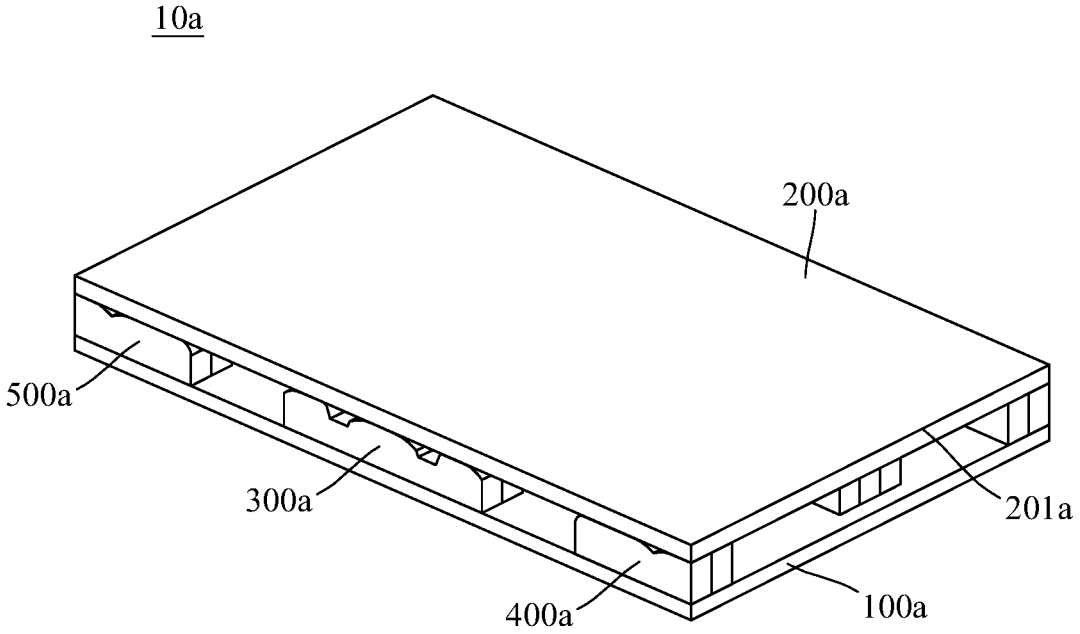
FIG. 1 is a perspective view of a pallet according to one embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
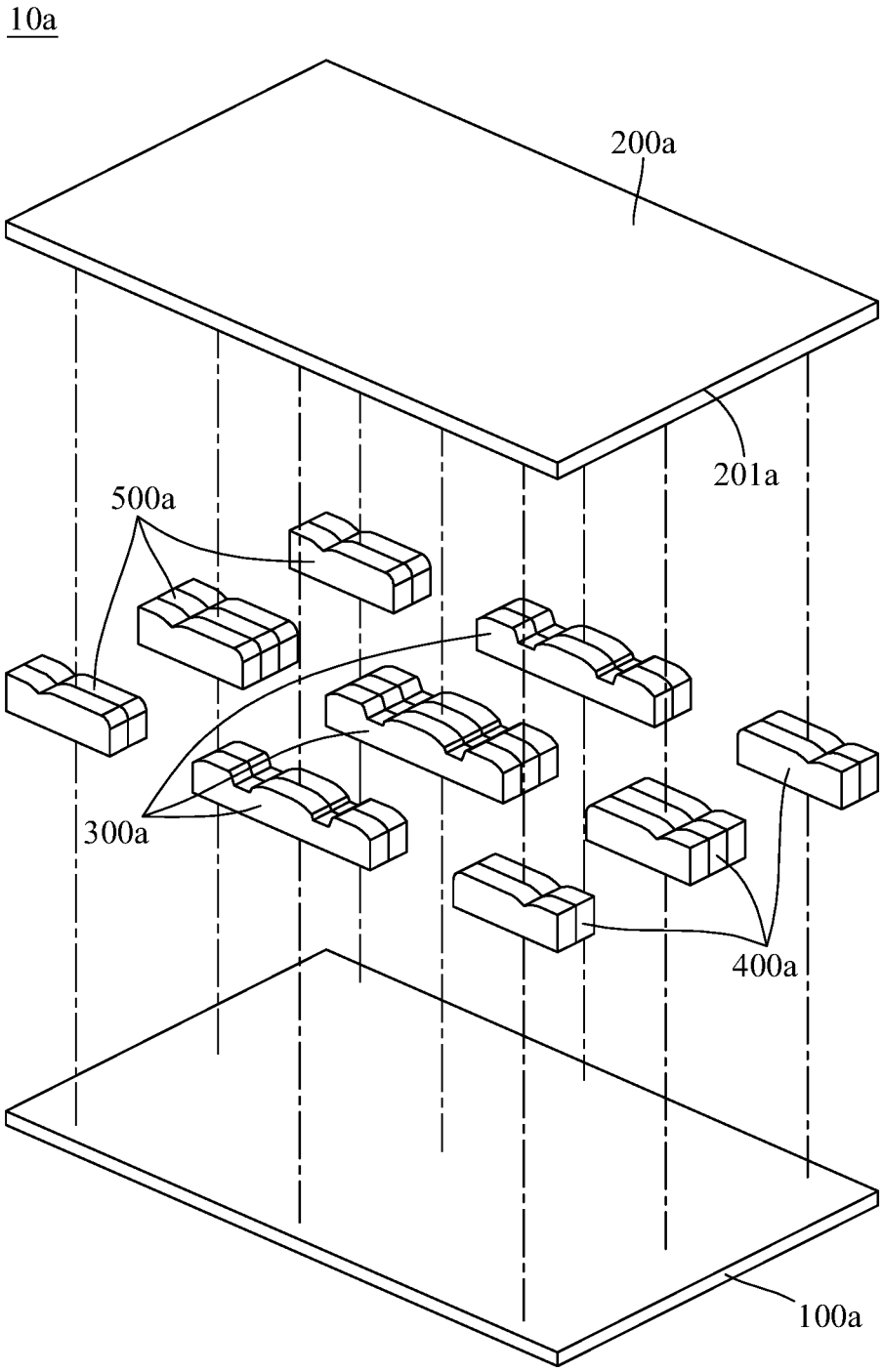
FIG. 2 is an exploded view of the pallet in FIG. 1.

Please refer to FIG. 1 and FIG. 2. FIG. 1 is a perspective view of a pallet 10*a* according to one embodiment of the present disclosure. FIG. 2 is an exploded view of the pallet 10*a* in FIG. 1.

In this embodiment, the pallet 10*a* includes a first board 100*a*, a second board 200*a*, at least one first elastic component 300*a* and at least one second elastic component 400*a*. When the pallet 10*a* is placed on a platform or on the ground, the first board 100*a* is located closer to the platform or ground than the second board 200*a*. That is, in some occasions, the first board 100*a* is located under the second board 200*a*. In such a case, the first board 100*a* is configured to support the second board 200*a*, and the second board 200*a* is configured to support goods (not shown). The present disclosure is not limited to the placement manner of the pallet 10*a*. In some embodiments, the pallet may be placed in a manner that the second board is located closer to the platform or ground than the first board, and the first board is configured to support goods.

In this embodiment, the first elastic components 300*a* and the second elastic components 400*a* are located between the first board 100*a* and the second board 200 and connected to the first board 100*a* and the second board 200 by, for example, adhesive (not shown). In this and some embodiments of the present disclosure, the pallet 10*a* may further include at least one third elastic component 500*a*. The third elastic components 500*a* are located between the first board 100*a* and the second board 200 and connected to the first board 100*a* and the second board 200 by, for example, adhesive (not shown). In this embodiment, the second elastic components 400*a* are located closer to an edge 201*a* of the second board 200*a* than the first elastic components 300*a*. In this and some embodiments, the third elastic components 500*a* are located away from the edge 201*a* of the second board 200*a* than the first elastic components 300*a*. In other words, the first elastic components 300*a* are located between the second elastic components 400*a* and the third elastic components 500*a*.

Note that the disclosure in not limited to the quantities of the first elastic components 300*a*, the second elastic components 400*a*, and the third elastic components 500*a*. In some other embodiments, the pallet may only include one first elastic component, one second elastic component and one third elastic component.

In this and some embodiments of the present disclosure, the first elastic components 300*a*, the second elastic components 400*a* and the third elastic components 500*a*, that are located between the first board 100*a* and the second board 200*a*, may each have a thickness approximately ranging from 75 mm to 78 mm. The first elastic components 300*a*, the second elastic components 400*a* and the third elastic components 500*a* are made of, for example, expanded polyethylene (as known as EPE foam) that can be restored to original shape after being forced and deformed by a certain degree of external force. Therefore, the first elastic components 300*a*, the second elastic components 400*a* and the third elastic components 500*a* are able to absorb vibrations or impact transmitted to the first board 100*a* and the second board 200*a* so as to eliminate or minimize the vibration or impact transmitted to the goods being placed on the second board 200*a*.

In this embodiment, the second elastic components 400*a* each have a density higher than that of the first elastic components 300*a*. In this and some embodiments of the present disclosure, the third elastic components 500*a* each have a density higher than that of the first elastic components 300*a*. Specifically, the density of each of the first elastic components 300*a* may approximately be 4 lb/ft$^3$, the density of each of the second elastic components 400*a* and the third elastic components 500*a* may approximately be 6 lb/ft$^3$. Therefore, each of the first elastic components 300*a* may have a larger amount of deformation than that of the second elastic components 400*a* and the third elastic components 500*a* while applying the same amount of external force thereto. Therefore, the first elastic components 300*a* can have a better capability of absorbing external force than the second elastic components 400*a* and the third elastic components 500*a* while allowing the second elastic components 400*a* and the third elastic components 500*a* to stable the position of the second board 200*a* relative to the first board 100*a*. Note that the densities of the first elastic components 300*a*, the second elastic components 400*a* and the third elastic components 500*a* can be changed according to actual requirements, such as the weight of the goods on the second board 200*a*.

Figure 3:
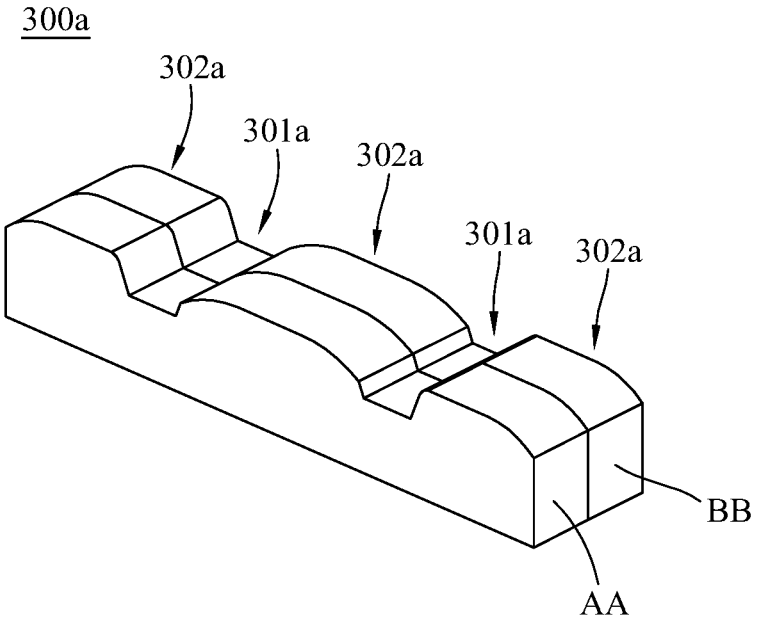
FIG. 3 is a perspective view of a first elastic component of the pallet in FIG. 1.

Please refer to FIG. 1 and further refer to FIG. 3, where FIG. 3 is a perspective view of the first elastic component 300*a* of the pallet 10*a* in FIG. 1. In this and some embodiments, the first elastic component 300*a* may include at least two pieces AA and BB of the same size and shape. The piece AA and the piece BB are fixed to each other by, for example, adhering. In the case of the first elastic component 300*a* having a thickness of approximately 80 mm, an EPE foam sheet of approximately 80 mm may be chosen and cropped to the first elastic component 300*a*; or two EPE foam sheets of approximately 40 mm may be chosen and respectively cropped to the pieces AA and BB that can be adhered to form the first elastic component 300*a*. That is, there are two ways to form the first elastic component 300*a*, and the choice of EPE foam sheet can be flexible. Furthermore, the second elastic component 400*a* and the third elastic component 500*a* may also include at least two pieces of the same size and shape and can be formed in a similar manner with the first elastic component 300*a*, and it is not repeated again. Note that the first elastic component, the second elastic component and the third elastic component may be made of a single piece in some other embodiments.

In more detail, in this and some embodiments of the present disclosure, the first elastic component 300*a* has at least one recess 301*a* and at least one protrusion 302*a*. Specifically, referring to FIG. 3, the first elastic component 300*a* has two recesses 301*a* and three protrusions 302*a*, but the present disclosure is not limited to the qualities of the recesses 301 and the protrusions 302*a*. In this and some embodiments of the present disclosure, the protrusions 302*a* are spaced apart from each other by the recesses 301*a*. The recesses 301*a* and the protrusions 302*a* are located at a side of the second board 200*a* and facing the second board 200*a*. That is, the protrusions 302*a* protrude toward the second board 200*a*. While the first elastic component 300*a* is pressed by the second board 200*a*, the protrusions 302*a* are deformed by the second board 200*a* and part of the protrusions 302*a* is moved to the recesses 301*a*; that is, the recesses 301*a* provide rooms for the deformed part of the protrusions 302*a* so that the first elastic component 300*a* is not easily deformed outward during deformation. Note that, the second elastic component 400*a* or the third elastic component 500*a* may also have recesses and protrusions that provide the same effect as the recesses 301*a* and the protrusions 302*a* and it is not be repeated again.

Figure 4:
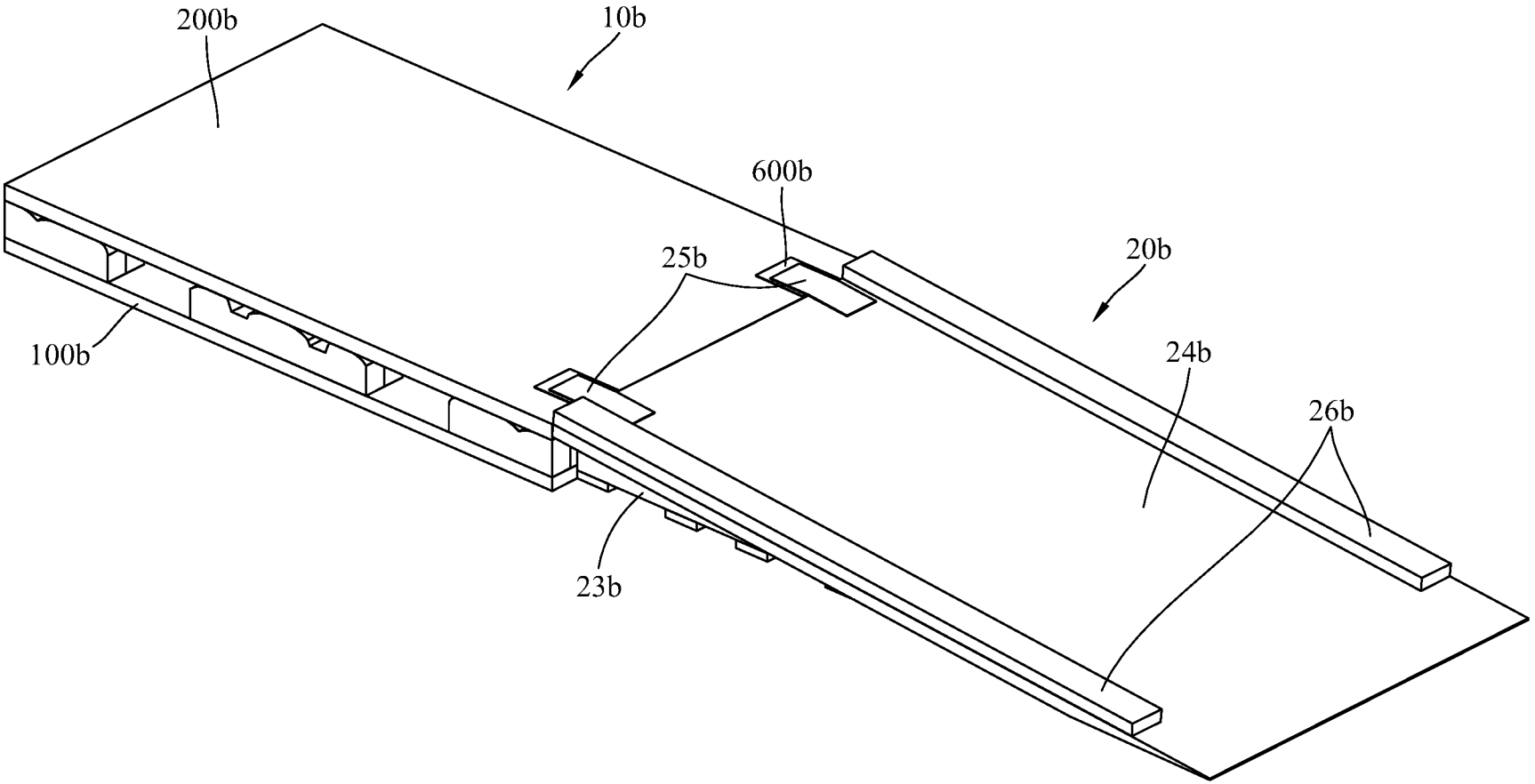
FIG. 4 is a perspective view of a pallet and a ramp according to another embodiment of the present disclosure.

Please refer to FIG. 4. FIG. 4 is a perspective view of a pallet 10*b* and a ramp 20*b* according to another embodiment of the present disclosure. Note that only the differences between this and the previous embodiments are illustrated hereinafter. In this and some embodiments of the present disclosure, the pallet 10*b* may further include at least one first adhesive component 600*b*. The first adhesive components 600*b* may be two pieces of one type of a hook-and-loop fastener, for example, that may be two hook fasteners. The first adhesive components 600*b* are disposed on a side of the second board 200*b* away from the first board 100*b*. A ramp 20*b* is also connected to the first adhesive components 600*b*; that is, the ramp 20*b* is connected to the pallet 10*b* via the first adhesive components 600*b*.

Figure 5:
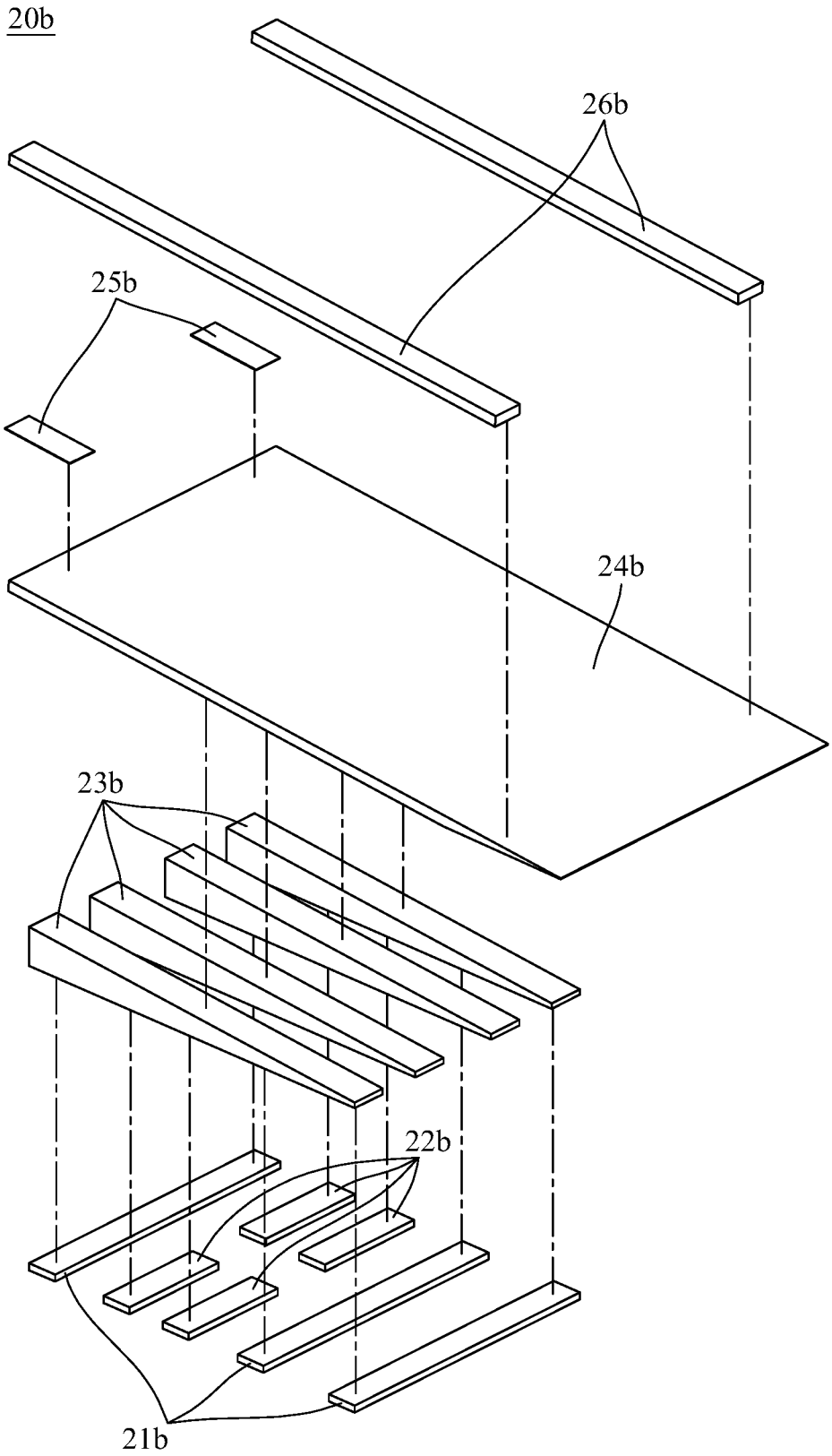
FIG. 5 is an exploded view of the ramp in FIG. 4.

The ramp 20*b* attached to the second board 200*b* is to make the goods easier to be moved onto the second board 200*b* from the platform/ground or vice versa. The detail of the ramp 20*b* is described below. Please refer to FIG. 4 and further refer to FIG. 5, where FIG. 5 is an exploded view of the ramp 20*b* in FIG. 4. In this and some embodiments, the ramp 20*b* includes at least one first lower reinforcement board 21*b*, at least one second lower reinforcement board 22*b*, at least one supporting block 23*b*, an upper board 24*b*, at least one second adhesive component 25*b*, at least one side barrier 26*b*. The ramp 20*b* may be placed on the platform/ground in a manner that first lower reinforcement boards 21*b* and the second lower reinforcement boards 22*b* are located closer to the platform/ground than the supporting blocks 23*b*. The effect of the first lower reinforcement boards 21*b* and the second lower reinforcement boards 22*b* is described hereinafter. Each of the supporting blocks 23*b* may be a long wedge-shaped object disposed on the first lower reinforcement board 21*b* and the second lower reinforcement board 22*b*. The upper board 24*b* is disposed on the inclined surfaces of the supporting blocks 23*b*. The second adhesive components 25*b* may be two pieces of the other type of the hook-and-loop fastener, for example, that may be two loop fasteners. The second adhesive components 25*b* are disposed on a side of the upper board 24*b* away from the supporting blocks 23*b*. Therefore, the ramp 20*b* can be easily and quickly connected to the pallet 10*b* by the second adhesive components 25*b* being tightly in contact with the first adhesive components 600*b*. Each of the side barriers 26*b* may be a long stick disposed on the side of the upper board 24*b* away from the supporting blocks 23*b* along the direction of the slope of the upper board 24*b*.

The ramp 20*b* can be fixed to a side of the second board 200*b* via the first adhesive components 600*b* and the second adhesive components 25*b* to create a continues path for the goods to be moved from the second board 200*b* to the platform/ground or vice versa. When the goods are placed on or moved along the upper board 24*b*, the supporting blocks 23*b* can support the upper board 24*b* and prevent it from being deformed, and the side barriers 26*b* can guide the goods and prevent the goods from falling off from the ramp 20*b*. In addition, the first lower reinforcement board 21*b* and the second lower reinforcement board 22*b* are able to keep the arrangement of the supporting blocks 23*b* so as to secure the structural strength of the ramp 20.

Figure 6:
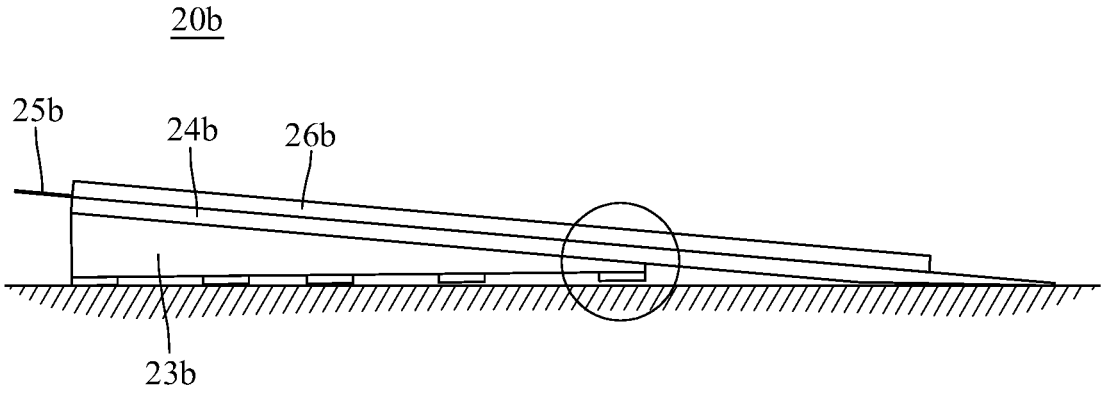
FIG. 6 is a side view of the ramp in FIG. 4.
Figure 7:
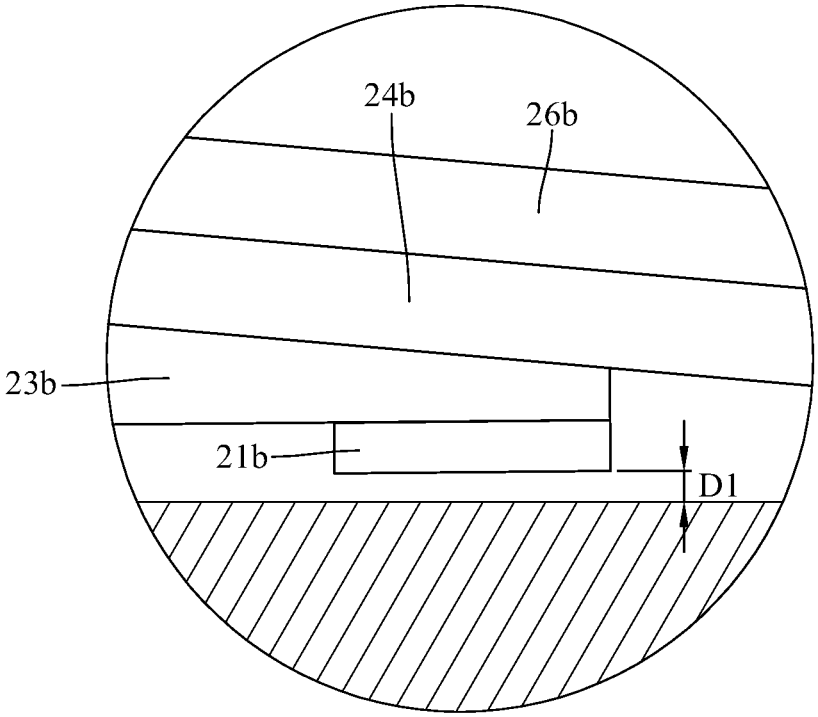
FIG. 7 is a partially enlarged view of the ramp in FIG. 6.

Please refer to FIG. 6 and FIG. 7. FIG. 6 is a side view of the ramp 20*b* in FIG. 4. FIG. 7 is a partially enlarged view of the ramp 20*b* in FIG. 6. In this and some embodiments of the present disclosure, the supporting blocks 23*b* may each have an uneven surface facing the first lower reinforcement boards 21*b*. Therefore, while the ramp 20*b* are placed on the platform/ground and the goods are not placed on or moved along the upper board 24*b*, as shown in FIG. 7, one or more of the first lower reinforcement boards 21*b* may have a gap D1 with respect to the platform/ground.

In such a case, when the goods are placed on or moved along the upper board 24*b*, the supporting blocks 23*b* may be slightly deformed toward the platform/ground to force all of the first lower reinforcement boards 21*b* to touch the platform/ground. That is, the gap D1 existing between the first lower reinforcement boards 21*b* and the platform/ground is eliminated. As the goods are removed, the supporting blocks 23*b* are restored to its original shape, and the first lower reinforcement boards 21*b* have a gap D1 with respect to the platform/ground again.

Therefore, the gap D1 is for the downward movement of the supporting blocks 23*b* while loading goods. If there is no gap D1 and the goods are in a weight enough to deform the upper board 24*b*, the deformation in the middle part of the upper board 24*b* may cause the end of the upper board 24*b* to move upward, and the upper board 24*b* might not be able to return to its original shape. As a result, the upper board 24*b* being unrecoverable deformed makes the goods relatively difficult to be moved between the upper board 24*b* and the platform/ground. Accordingly, the gap D1 can prevent the aforementioned problem.

Figure 8:
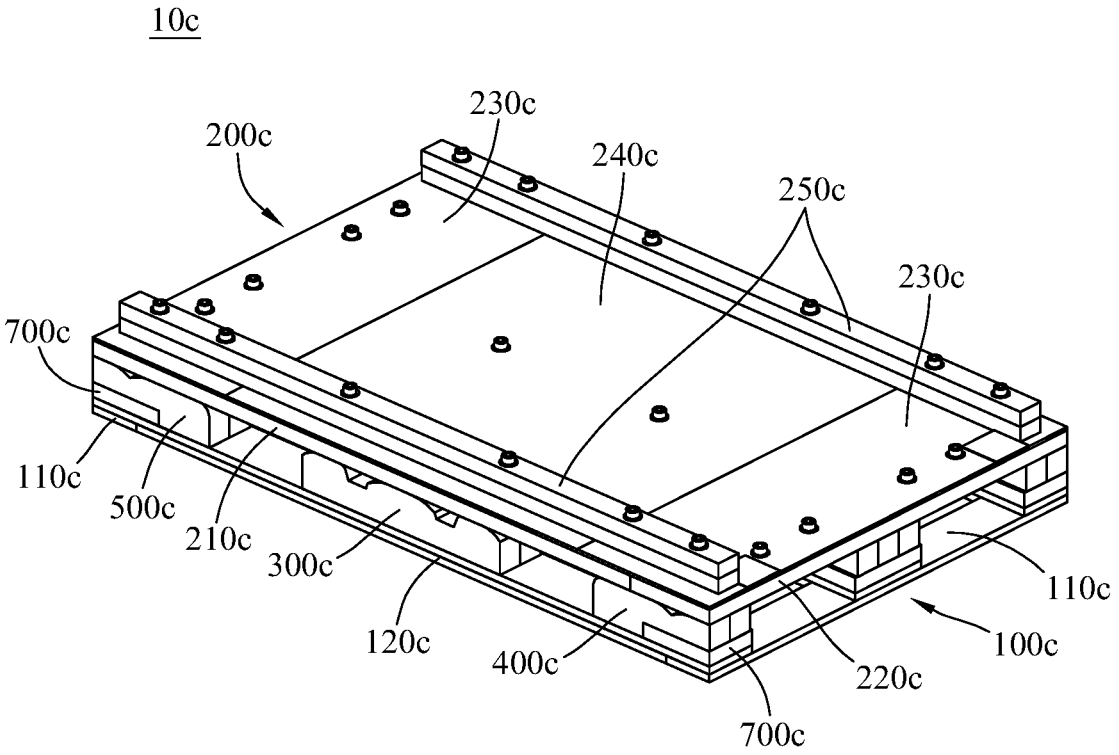
FIG. 8 is a perspective view of a pallet according to further another embodiment of the present disclosure.
Figure 9:
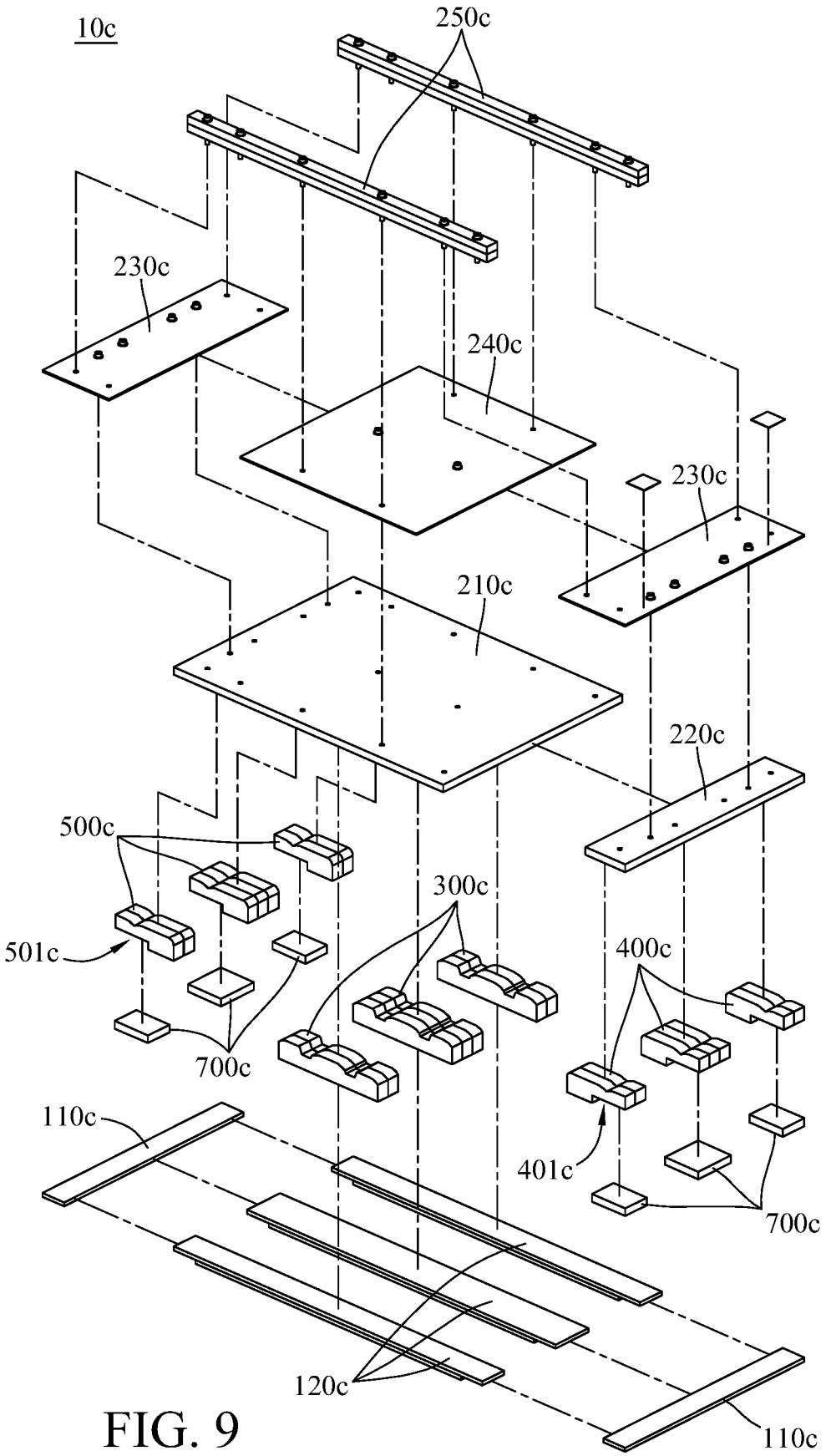
FIG. 9 is an exploded view of the pallet in FIG. 8.

Please refer to FIG. 8 and FIG. 9. FIG. 8 is a perspective view of a pallet 10*c* according to further another embodiment of the present disclosure. FIG. 9 is an exploded view of the pallet 10*c* in FIG. 8. Note that only the differences between this and the previous embodiments are illustrated hereinafter. In this and some embodiments of the present disclosure, the second board 200*c* may further include a first load board 210*c* and a second load board 220*c*. The first load board 210*c* and the second load board 220*c* are made of, for example, laminated veneer lumber or plywood. The first load board 210*c* and the second load board 220*c* are disposed side by side on a side of the first elastic components 300*c* away from the first board 100*c*. The area of the largest surface of the first load board 210*c* is larger than the area of the largest surface of the second load board 220*c*. The area of the largest surface of the first load board 210*c* may approximately be 1220 mm×880 mm, and the area of the largest surface of the second load board 220*c* may approximately be 880 mm×180 mm. Generally, a plate of plywood is in a standard size of 2440 mm×1220 mm, and it only sufficient for one board of 1400 mm×880 mm (i.e., the second board 200*c*), or for two boards of 1220 mm×880 mm (i.e., two first load board 210*c*) and two boards of 880 mm×180 mm (i.e., two second load boards 220*c*). Therefore, the latter best uses of one standard plate of plywood and produces more of the second board 200*c* from the one standard plate of plywood. Note that the second board may be made of a single piece in some embodiments.

In this and some embodiments of the present disclosure, the second board 200*c* may further include two third load boards 230*c* and a fourth load board 240*c*. The third load boards 230*c* may be polypropylene boards, and the fourth load board 240*c* located between the third load boards 230*c* may be a high density fiber board. The third load boards 230*c* and the fourth load board 240*c* are disposed side by side on a side of the first load board 210*c* away from the first board 100*c*. The third load boards 230*c* have a hardness greater than that of the first load board 210*c*, the second load board 220*c* and the fourth load board 240*c*. Some goods, such as a server cabinet, may have wheels mounted on the bottom corners thereof, and which will put pressure mostly on the third load boards 230*c*. The hardness of the third load boards 230*c* is able to make the third load boards 230*c* less likely to be deformed by the goods, which allows the goods to be moved on the second board 200*c* smoothly.

In this embodiment and some embodiments of the present disclosure, the second board 200*c* may further include at least one reinforcement stick 250*c*. Each of the reinforcement sticks 250*c* may be a wooden stick disposed on a side of the third load boards 230*c* and the fourth load board 240*c* away from the first board 100*c* by, for example, screwing, such that the reinforcement sticks 250*c* may also be fixed to the first load board 210*c* and the second load board 220*c*.

In this and some embodiments of the present disclosure, the first board 100*c* may further include at least one first reinforcement board 110*c* and at least one second reinforcement board 120*c*. The first reinforcement boards 110*c* are partially covered by part of the second reinforcement boards 120*c*, and they are disposed on a side of the first elastic components 300*c* away from the second board 200*c*. The area of the largest surface of the first reinforcement board 110*c* and the area of the largest surface of the second reinforcement board 120*c* are smaller than the area of the largest surface of the second board 200*c*. Since the first reinforcement board 110*c* and the second reinforcement boards 120*c* may not directly support the goods, they do not have to be in the same size as the second board 200*c*, thereby saving cost. That is, part of the first board 100*c* absent of contacting the first elastic components 300*c*, the second elastic components 400*c* and the third elastic components 500*c* can be removed.

In this and some embodiments of the present disclosure, the pallet 10*c* may further include at least one protection block 700*c*. Each of the second elastic components 400*c* may further have an accommodation space 401*c* at a side of each of the second elastic components 400*c* away from the first elastic components 300*c*, and each of the third elastic components 500*c* may further have an accommodation space 501*c* at a side of each of the third elastic components 500*c* away from the first elastic components 300*c*. Each of the protection blocks 700*c* is made of, for example, wood. Some of the protection blocks 700*c* are disposed in the accommodation space 401*c* of the second elastic components 400*c* and located between the second elastic components 400*c* and the first board 100*c*, and the rests of the protection blocks 700*c* are disposed in the accommodation space 501*c* of the third elastic components 500*c* and located between the third elastic components 500*c* and the first board 100*c*. While the pallet 10*c* is being lifted by a forklift (not shown), the protection blocks 700*c* can protect the second elastic components 400*c* or the third elastic components 500*c* from being hit by the forks of the forklift and thus preventing the second elastic components 400*c* or the third elastic components 500*c* from being deformed by the forks of the forklift.

According to the pallet discussed above, each of the first elastic components may have a larger amount of deformation than that of the second elastic components and the third elastic components while applying the same amount of external force thereto. Therefore, the first elastic components can have a better capability of absorbing external force than the second elastic components and the third elastic components while allowing the second elastic components and the third elastic components to stable the position of the second board relative to the first board.

In some embodiments, the first elastic component has at least one recess and at least one protrusion. While the first elastic component is pressed by the second board, the protrusions are deformed by the second board and part of the protrusions is moved to the recesses; that is, the recesses provide rooms for the deformed part of the protrusions so that the first elastic component is not easily deformed outward during deformation.

In some embodiments, the pallet may further include at least one first adhesive component configured to be connected to a ramp. The ramp attached to the second board is to make goods easier to be moved onto the second board from the platform/ground or vice versa.

In some embodiments, the hardness of the third load boards is able to make the third load boards less likely to be deformed by the goods, which allows the goods to be moved on the second board smoothly.

In some embodiments, the pallet may further include at least one protection block. While the pallet is being lifted by a forklift, the blocks can protect the second elastic components or the third elastic components from being hit by the forks of the forklift and thus preventing the second elastic components or the third elastic components from being deformed by the forks of the forklift.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A pallet, comprising:

a first board;

a second board;

a first elastic component, disposed between the first board and the second board;

a second elastic component, disposed between the first board and the second board, wherein the second elastic component is closer to an edge of the second board than the first elastic component, and the second elastic component has a density higher than that of the first elastic component, and the second elastic component further has an accommodation space away from the first elastic component; and a block, disposed in the accommodation space of the second elastic component and located between the second elastic component and the first board.

2. The pallet according to claim 1, further comprising a first adhesive component, wherein the first adhesive component is disposed on a side of the second board away from the first board, and the first adhesive component is configured to connect a ramp.

3. The pallet according to claim 1, further comprising a third elastic component, wherein the first elastic component is located between the second elastic component and the third elastic component, and the third component has a density higher than that of the first elastic component.

4. The pallet according to claim 1, wherein the first elastic component or the second elastic component has a recess facing a side of the second board and located at the side of the second board.

5. The pallet according to claim 1, wherein the first elastic component has a protrusion protruding towards a side of the second board and is located at the side of the second board.

6. The pallet according to claim 1, wherein the second board further comprises a first load board and a second load board that are disposed side by side on a side of the first elastic component and the second elastic component away from the first board, and an area of a largest surface of the first load board is larger than an area of a largest surface of the second load board.

7. The pallet according to claim 6, wherein the second board further comprises a plurality of third load boards and a fourth load board that are disposed side by side on a side of the first load board and the second load board away from the first board, the fourth load board is located between the plurality of third load boards, and the plurality of third load boards have a hardness greater than that of the first load board, the second load board and the fourth load board.

8. The pallet according to claim 7, wherein the second board further comprises a reinforcement stick disposed on a side of the third load boards and the fourth load board away from the first board.

9. The pallet according to claim 1, wherein the first board further comprises a first reinforcement board and a second reinforcement board that are disposed side by side on a side of the first elastic component and the second elastic component away from the second board, and an area of a largest surface of the first reinforcement board and an area of a largest surface of the second reinforcement board are smaller than an area of a largest surface of the second board.

* * * * *